US006358900B1

(12) United States Patent
Wigley et al.

(10) Patent No.: US 6,358,900 B1
(45) Date of Patent: Mar. 19, 2002

(54) HARD SURFACE CLEANERS COMPRISING AN ETHOXYLATED QUATERNARY AMMONIUM COMPOUND AND AN ANIONIC SURFACTANT

(75) Inventors: Susan Wigley, Hull; Mark Laing, Beverley, both of (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/622,075

(22) PCT Filed: Feb. 23, 1999

(86) PCT No.: PCT/GB99/00397

§ 371 Date: Nov. 21, 2000

§ 102(e) Date: Nov. 21, 2000

(87) PCT Pub. No.: WO99/43773

PCT Pub. Date: Sep. 2, 1999

(30) Foreign Application Priority Data

Feb. 26, 1998 (GB) ..... 9804022

(51) Int. Cl.[7] ..... C11D 1/65; C11D 3/43

(52) U.S. Cl. ..... 510/180; 510/181; 510/182; 510/235; 510/237; 510/243; 510/405; 510/426; 510/432; 510/433; 510/504

(58) Field of Search ..... 510/235, 237, 510/180, 181, 182, 243, 405, 426, 432, 433, 504

(56) References Cited

U.S. PATENT DOCUMENTS

| | | | | |
|---|---|---|---|---|
| 4,284,435 A | | 8/1981 | Fox | 134/2 |
| 4,806,260 A | | 2/1989 | Broze et al. | 252/8.8 |
| 4,919,830 A | | 4/1990 | Durbut et al. | 252/153 |
| 4,919,839 A | * | 4/1990 | Durbut et al. | 252/153 |
| 5,252,245 A | | 10/1993 | Garabedian et al. | 252/153 |
| 5,795,853 A | | 8/1998 | Denis et al. | 510/182 |

FOREIGN PATENT DOCUMENTS

| | | | |
|---|---|---|---|
| GB | 2 075 043 A | 11/1981 | C11D/1/835 |
| WO | WO95/33812 | 12/1995 | C11D/1/94 |
| WO | WO98/44080 | 10/1998 | C11D/1/12 |

OTHER PUBLICATIONS

Copy of GB Patent Office Search Report for GB 9804022.3 dated Jun. 17, 1998.

* cited by examiner

*Primary Examiner*—Charles Boyer
(74) *Attorney, Agent, or Firm*—Fish & Richardson P.C.

(57) ABSTRACT

A hard surface cleaner comprises: an ethoxylated quaternary ammonium compound comprising a $C_{10-25}$ ; alkyl or alkenyl radical and a polyalkoxy chain having from 2 to 20 ethoxy groups and from 0 to 2 propoxy groups; a glycol ether and/or a $C_{1-22}$ alcohol; and an anionic surfactant.

21 Claims, No Drawings

HARD SURFACE CLEANERS COMPRISING AN ETHOXYLATED QUATERNARY AMMONIUM COMPOUND AND AN ANIONIC SURFACTANT

BACKGROUND OF THE INVENTION

The present invention relates to compositions for cleaning hard surfaces, and in particular to compositions suitable for cleaning glass and glossy or shiny surfaces.

A particularly important feature of such compositions is that the surface when cleaned must not have any streaks or smears and, although numerous-compositions for cleaning glass and like materials have been proposed, providing compositions which clean effectively whilst avoiding streaking or smearing has been a particular technical challenge.

A further advantage of cleaning compositions for glass and shiny or glossy surfaces is the ability to reduce or to avoid the build up of static charge. It will be appreciated that the presence of static charge on the surface causes the rapid re-deposition of dust and like particles by attraction o such particles onto the surface from the air. The benefits achieved by cleaning of the surface are thus rapidly diminished.

Up until now anionic surfactants have not been added in the same composition as cationic surfactants because the anionic surfactants interfere with the activity of cationic surfactants in so far as anti-static and anti-microbial properties are concerned. Surprisingly it has now been found that by using a quaternary ammonium compound as the cationic surfactant, compositions containing a cationic and anionic surfactant can be made so that the benefit of both the anionic surfactant (i.e. high detergency and low smearing) and the benefit of the cationic surfactants (i.e. good anti-microbial and good anti-static properties) can be obtained.

Accordingly, it is an aim of the present invention to provide a cleaning composition, in particular for glass and glossy or shiny surfaces, which has good cleaning properties, does not cause smears or streaks, and also has good anti-microbial activity as well as having good anti-static properties, that is, the ability to reduce or prevent the build up of static charge on the surface.

SUMMARY OF THE INVENTION

According to the present invention, there is provided an aqueous cleaning composition, preferably a hard surface cleaning composition, comprising:

i) 0.01%–5% of one or more ethoxylated quaternary ammonium compounds (hereinafter component i);

ii) 1%–10% of at least one glycol ether and/or $C_{1-22}$ alcohols (hereinafter component ii); and iii) 0.005% to 2% of an anionic surfactant (hereinafter component iii);

all percentages being by weight.

Component i) preferably comprises one or more compounds of the formula I

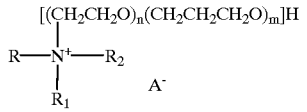

(I)

in which $A^-$ is an anion preferably $Cl^-$ or $SO_4^-$;

R is an $C_{10-25}$ alkyl or $C_{10-25}$ alkenyl radical preferably $C_{12-22}$ alkyl or $C_{12-22}$ alkenyl;

each of $R_1$ and $R_2$ independently is selected from hydrogen and $C_{1-6}$ alkyl;

n is preferably a number from 2 to 20, especially 3–6 ; and m is 0 to 2, preferably 0.

More preferred quaternary ammonium compounds are $C_{12-16}$ alkyl ethoxylated ammonium compounds. Suitable commercially available ethoxylated ammonium compounds include polyethylene glycol products e.g. cocoalkyl pentaethoxymethylammonium methosulphate (PEG-5 cocomonium methosulphate—derived from coconut fatty acid).

For clarity in formula I the ethylene oxide recurring unit or the propylene oxide recurring unit may be directly attached to the N atom.

In preferred formulations, component i) is preferably present in a total amount of from 0.1% to 2% and more preferably from 0.1% to 0.5%.

Component ii) is preferably one or more compounds of the formula II:

$$R^3—O—CH_2—CH(OH)—R^4 \quad (II)$$

in which $R^3$ is a $C_{2-6}$ alkyl or $C_{2-6}$ alkenyl; and $R^4$ is a $C_{1-6}$ alkyl radical preferably $C_{1-4}$ alkyl.

Particularly preferred glycol ethers are butoxypropanol and methoxyisopropanol. Ethylene glycol monobutyl ether is also efficacious, but is less preferred for environmental reasons.

Component ii) is preferably present in a total amount of from 2% to 8%, more preferably from 3%–6%, and especially from 3.5% to 5.5%.

Preferably component iii) is selected from sarcosinates, more preferably, sodium lauroyl sarcosinates. Preferably component iii) is present in a total amount of 0.01–1%, more preferably, 0.02–0.5%.

DETAILED DISCLOSURE

In this specification any alkyl group that is capable of being linear or branched is linear or branched unless indicated to the contrary.

The formulations of the present invention are particularly advantageous with regard to prior art compositions based on ether carboxylates and non-ethoxylated quaternary compounds as the latter result in smearing occurring on cleaning.

Thus, the combination of components i), ii) and iii) in the compositions of the present invention provide excellent anti-microbial properties and charge reduction on plastic surfaces whilst at the same time avoiding streaking and smearing on the surface.

The compositions of the invention may also advantageously include a wetting agent, in particular a fatty alcohol ethoxylate such as Volpo T7 (Trade Mark) available from Croda. Such a wetting agent may be present in an amount preferably of from 0.001% to 0.5%, more preferably from 0.002% to 0.1%.

The compositions of the invention may also include minor amounts of optional ingredients such as fragrances, colourants, ammonia, acetic acid, $C_{1-6}$ alcohols provided that such optional ingredients do not deleteriously affect the anti-smearing, antibacterial or anti-static properties of the compositions.

Preferably, these optional ingredients are present in an amount of 0 to 2%, more preferably 0 to 1%.

In order to illustrate the invention, the following examples were prepared and tested as illustrated below.

EXAMPLE 1

In order to assess the level of smearing caused by this formulation, a sample of the formulation was applied in predetermined amounts to a lean dry paper towel which was then applied to a clean g ass mirror tile and moved once with even pressure across the tile. After allowing the tile to dry, the level of smearing was assessed using a scale of 0 to 4 where 4 indicates severe smears or streaks and 0 indicates no smears or streaks.

The anti-static properties of the formulation was tested using a Charge Decay Test Unit from John Chubb Instrumentation, Cheltenham, UK. The test procedure involves the induction of a static charge on a surface and measurement of the time taken for the charge to dissipate. The latter time is expressed as 1/e and a lower value indicates a higher rate of charge dissipation and better anti-static properties. Tests were carried out on glass and on polycarbonate surfaces and the results are indicated below.

| | |
|---|---|
| Butoxypropanol | 2.1 |
| Methoxypropanol | 1.8 |
| Sodium lauroyl sarcosinate | 0.1 |
| Fragrance | 0.1 |
| Acid Blue 3 | 0.015 |
| PEG-5 Cocomonium methosulphate | 0.205 |
| Water | 95.68 |
| Smearing level | 0.09 |
| Charge dissipation time (glass) | 0.38 |
| Charge dissipation time (polycarbonate) | 0.25 |
| Charge dissipation time (acrylic) | 0.23 |

Untreated surfaces were also tested for which the charge dissipation times were:

| | |
|---|---|
| glass | 1.6 |
| polycarbonate | >600 |

In comparison to the formulation above, a second formulation without the anionic surfactant was made up as follows:

| | |
|---|---|
| Butoxypropanol | 2.1 |
| Methoxypropanol | 1.8 |
| Ammonia (33%) | 0.145 |
| Fragrance | 0.1 |
| Patent Blue | 0.001 |
| PEG-5 Cocomonium methosulphate | 0.205 |
| Water | 95.649 |
| Smearing level | 0.56 (faded) |

EXAMPLE 2

| | |
|---|---|
| Butoxypropanol | 2.1 |
| Methoxypropanol | 1.8 |
| Ammonia (33%) | 0.145 |
| Fragrance | 0.1 |
| Duasyn Direct Turquoise | 0.015 |
| PEG-5 Cocomonium methosulphate | 0.205 |

-continued

| | |
|---|---|
| Sodium lauroyl sarcosinate | 0.1 |
| Water | 95.535 |
| Smearing level | 0.08 |
| Charge dissipation time (glass) | 0.99 |
| Charge dissipation time (polycarbonate) | 0.33 |
| Charge dissipation time (acrylic) | 0.34 |

EXAMPLE 3

Three formulations were made up according to Table 1 below. Two competitor products A and B were also tested. (Product A does not state its active ingredients and Product B discloses 3.5% w/w isopropanol and 0.25% propylene glycol as the active microbiocide ingredients.)

All five formulations were tested for bacterial kill at an in test concentration of 80% v/v using EN1276 in the presence of 0.3% w/v bovine serum albumin (dirty conditions).

EN1276 is a European Standard describing a suspension test method for establishing whether a chemical disinfectant or antiseptic has or does not have a bactericidal activity. The parameters and tests methods outlined in EN1276 are incorporated herein by reference.

The microbiocidal effectiveness results are given in table 2.

TABLE 1

Formulation details

| Formulation Number | 115 | 115A |
|---|---|---|
| | % w/w | |
| Butoxypropanol | 2.1 | 2.1 |
| Methoxypropanol | 1.8 | 1.8 |
| Dye | 0.015 | — |
| Peg-5 Cocomonium methosulphate | 0.205 | 0.205 |
| Sodium lauroyl sarcosinate | 0.1 | 0.1 |
| Perfume | 0.1 | 0.1 |
| Ammonia (25%) | 0.2 | 0.2 |
| Soft water | 95.48 | 95.495 |

Formulation Number 115 has been in storage for one year. Formulation Number 115A is newly made.

TABLE 2

ME Test Results

| | | Microbiocidal Effect (ME) Values Against | | | | | | | |
|---|---|---|---|---|---|---|---|---|---|
| Sample | Conc (% v/v) | *Ps. aeruginosa* | | *S. aureus* | | *Ent. hirae* | | *E. coli* | |
| 115 | 80 | >5.1 | >5.5 | >5.6 | >5.6 | >5.5 | 4.1 | >5.4 | >5.4 |
| 115A | 80 | >5.1 | >5.5 | >5.6 | >5.6 | >5.5 | 4.5 | >5.4 | >5.4 |
| Prod A | 80 | >5.1 | >5.5 | 4.7 | >5.6 | 4.2 | 4.7 | >5.4 | >5.4 |
| Prod B | 80 | >5.1 | >5.5 | 3.5 | 2.6 | 4.6 | 4.5 | 4.6 | 5.4 |

Both competitor products fail the requirements of EN1276 by falling short of the requirements to meet classification as a disinfectant (ME values of at least 5.0 against all four test organisms.)

The compositions according to the invention show no loss of activity after 1 year of storage (Formulation 115) and both formulations achieved an EN1276 pass showing ME values >5.0 against all organisms.

What is claimed is:

1. A hard surface cleaning composition comprising:

(i) from 0.01–5% of one or more ethoxylated quaternary ammonium compounds;

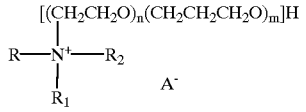

wherein:

$A^-$ is an anion;

R is a $C_{10-25}$ alkyl or $C_{10-25}$ alkenyl radical;

each of $R_1$ and $R_2$ independently is selected from hydrogen and $C_{1-6}$ alkyl;

n is a number from 2 to 20; and m is a number from 0 to 2;

(ii) from 1%–10% of at least one glycol ether and/or $C_{1-22}$ alcohol; and (iii) from 0.005 to 2% of an anionic surfactant, all percentages being by weight.

2. A composition according to claim 1 which component (i) is present in an amount of 0.1% to 2%.

3. A composition according to claim 2 in which component (i) is present in an amount of from 0.1% to 0.5%.

4. A composition according to claim 1 wherein:

$A^-$ is chloride or methosulphate;

R is a $C_{12-22}$ alkyl or $C_{12-22}$ alkenyl radical;

n is a number from 3 to 6; and m is 0.

5. A composition according to claim 4 in which component (i) is cocoalkyl pentaethoxymethylammonium methosulphate (PEG-5 cocomonium methosulphate).

6. A composition according to claim 1 in which component (ii) is a compound of the formula

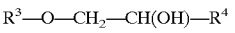

wherein:

$R^3$ is a $C_{1-6}$ alkyl or $C_{206}$ alkenyl radical; and $R^4$ is a $C_{1-6}$ alkyl radical.

7. A composition according to claim 6 wherein $R_4$ is $C_{1-4}$ alkyl.

8. A composition according to claim 7 in which component (ii) is butoxypropanol or methoxyisopropanol.

9. A composition according to claim 6 in which component (ii) is present in an amount of from 2% to 8%.

10. A composition according to claim 9 in which component (ii) is present in an amount of from 3% to 6%.

11. A composition according to claim 1 in which component (iii) is a sarcosinate.

12. A composition according to claim 11 in which component (iii) is sodium lauroyl sarcosinate.

13. A composition according to claim 11 in which component (iii) is present in an amount of from 0.01% to 1%.

14. A composition according to claim 1 further including from 0.001 % to 0.5% of a wetting agent.

15. A composition according to claim 14 in which the wetting agent is a fatty alcohol ethoxylate.

16. A composition according to claim 1 further including one or more optional ingredients selected from fragrances, colourants, ammonia, acetic acid and $C_{1-6}$ alcohols.

17. A composition as claimed in claim 16 wherein the optional ingredients are present in an amount not exceeding 2%.

18. A method of cleaning a hard surface which comprises applying thereto a detergently effective amount of an aqueous composition comprising:

(i) from 0.01–5% of one or more ethoxylated quaternary ammonium compounds of the formula

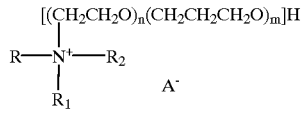

wherein:

$A^-$ is an anion;

R is a $C_{10-25}$ alkyl or $C_{10-25}$ alkenyl radical;

each of $R_1$ and $R_2$ independently is selected from hydrogen and $C_{1-6}$ alkyl;

n is a number from 2 to 20; and m is a number from 0 to 2;

(ii) from 1%–10% of at least one glycol ether and/or $C_{1-22}$ alcohol; and (iii) from 0.005 to 2% of an anionic surfactant, all percentages being by weight.

19. A method according to claim 18 in which the composition comprises:

(i) from 0.1% to 2% of the ethoxylated quaternary ammonium compounds (ii) from 2% to 8% of

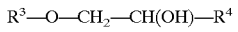

wherein:

$R^3$ is a $C_{1-6}$ alkyl or $C_{2-6}$ alkenyl radical; and $R^4$ is a $C_{1-6}$ alkyl radical; and (iii) from 0.01 % to 1% of a sarcosinate.

20. A method according to claim 19 in which, in component (i)

$A^-$ is chloride or methosulphate;

R is a $C_{12-22}$ alkyl or $C_{12-22}$ alkenyl radical;

n is a number from 3 to 6; and m is 0, and component (ii) is butoxypropanol or methoxyisopropanol.

21. A method according to claim 20 in which component (i) is cocoalkyl pentaethoxymethylammonium methosulphate and component (iii) is sodium lauroyl sarcosinate.

* * * * *

UNITED STATES PATENT AND TRADEMARK OFFICE

CERTIFICATE OF CORRECTION

PATENT NO. : 6,358,900 B1 
DATED : March 19, 2002
INVENTOR(S) : Mark Laing and Susan Wigley It is certified that error appears in the above-identified patent and that said Letters Patent is hereby corrected as shown below:

Column 5,
Line 26, insert -- in -- after "claim 1".
Line 43, "$C_{206}$" should be changed to -- $C_{2-6}$ --.

Signed and Sealed this

Third Day of December, 2002

JAMES E. ROGAN
*Director of the United States Patent and Trademark Office*